US006402573B1

(12) United States Patent
Yeomans

(10) Patent No.: US 6,402,573 B1
(45) Date of Patent: Jun. 11, 2002

(54) TERMINAL POSITION ASSURANCE DEVICE

(75) Inventor: Michael Yeomans, Camp Hill, PA (US)

(73) Assignee: Yazaki North America

( * ) Notice: Subject to any disclaimer, the term of this patent is extended or adjusted under 35 U.S.C. 154(b) by 0 days.

(21) Appl. No.: 09/876,518

(22) Filed: Jun. 7, 2001

(51) Int. Cl.[7] ..... H01R 13/436
(52) U.S. Cl. ..... 439/752
(58) Field of Search ..... 439/752, 595

(56) References Cited

U.S. PATENT DOCUMENTS

| | | | | |
|---|---|---|---|---|
| 5,100,345 A | | 3/1992 | Endo | 439/752 |
| 5,620,346 A | | 4/1997 | Okumura | 439/752 |
| 5,827,093 A | | 10/1998 | Okabe | 439/752 |
| 6,116,954 A | * | 9/2000 | Ries | 439/752 |
| 6,247,966 B1 | * | 6/2001 | Klein et al. | 439/752 |

FOREIGN PATENT DOCUMENTS

| | | |
|---|---|---|
| JP | 55-93979 | 6/1980 |

* cited by examiner

*Primary Examiner*—Gary F. Paumen
(74) *Attorney, Agent, or Firm*—Young & Basile

(57) ABSTRACT

A TPA (terminal position assurance) member and connector combination in which the connector is specially configured to latch the TPA member at forward and rearward ends of the connector, the TPA member further being provided with mating locking structure so as to securely lock it at both ends to the connector. In a preferred form, one end of the TPA latching structure is provided with both pre-attachment and full locking structure which provides for a two-stage locking sequence giving both visual and tactile indications to the assembler as to the condition of the TPA.

5 Claims, 5 Drawing Sheets

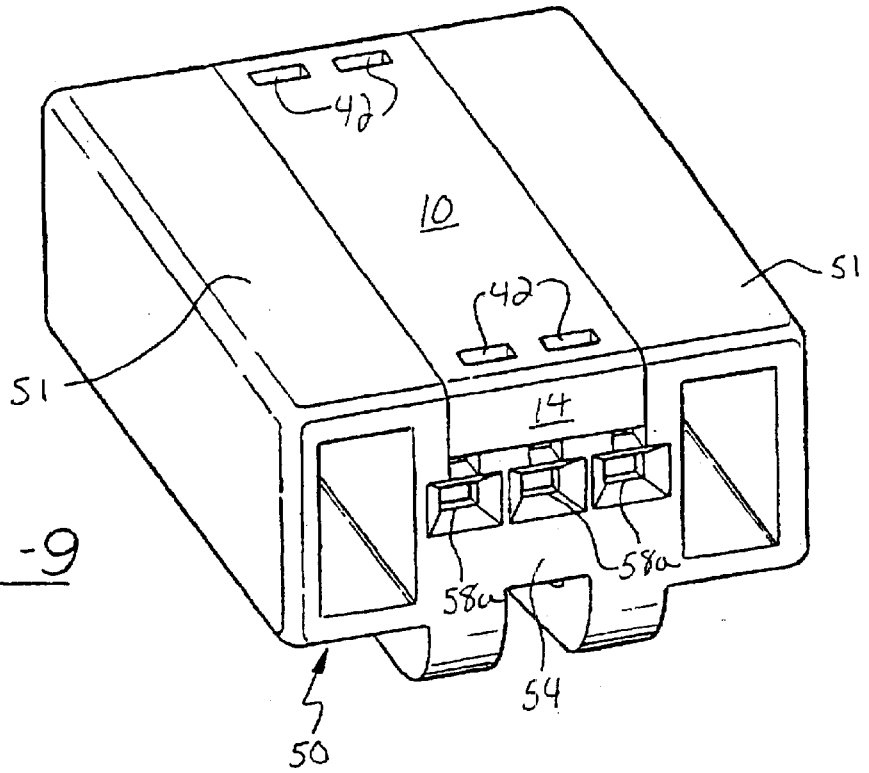
FIG-9
FIG-8
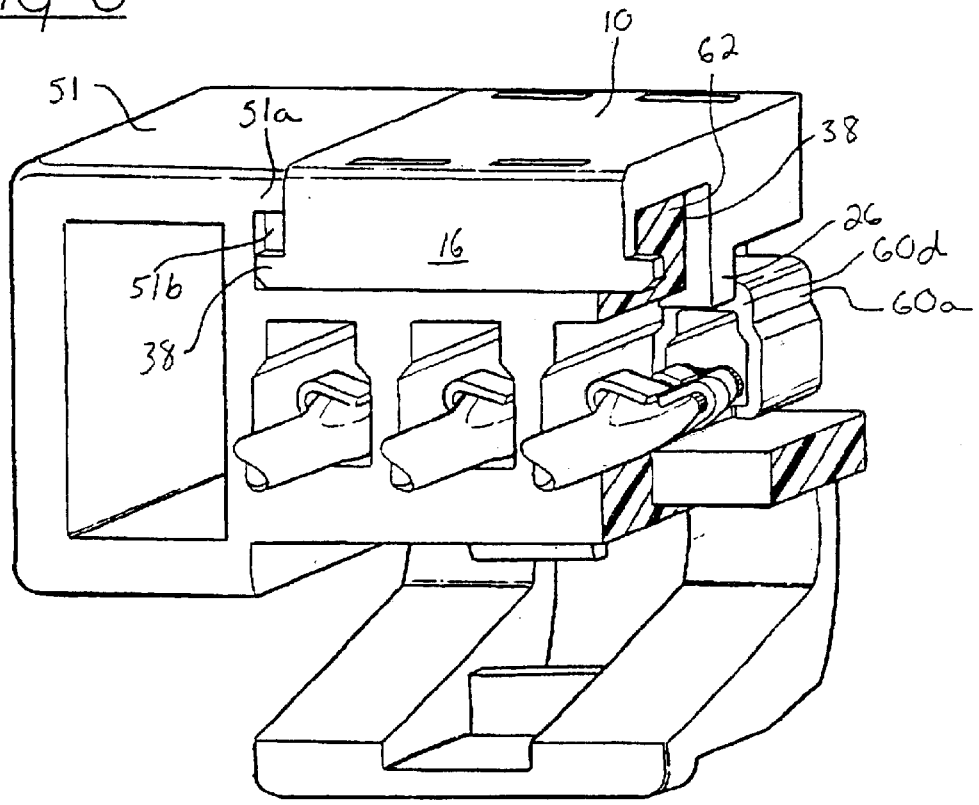

TERMINAL POSITION ASSURANCE DEVICE

FIELD OF THE INVENTION

The present invention is in the field of terminal position assurance (TPA) devices, used in electrical connector terminals to securely lock inserted wire terminals in their cavities.

BACKGROUND OF THE INVENTION

Terminal position assurance (TPA) devices are used in the electrical connector art to secure inserted wire harness terminals in their connector cavities, in proper position for electrically mating with the terminals from a mating connector or other electrical component. The TPA devices are often formed separately from the connector and are secured to the connector only after all terminals have been inserted into the connector. Such TPA devices have the usual disadvantages associated with having to provide multiple parts to an assembly station, such as misplaced parts and the problem of separate parts being dropped into inaccessible or sensitive locations.

In addition to their terminal-securing function, TPA devices are also typically designed to provide tactile and visual indication of an insufficiently inserted terminal. This is usually achieved by structuring the TPA device such that it cannot be fully engaged with the connector due to interference from an improperly inserted terminal.

TPA-type devices have also been referred to as terminal locking blocks, terminal detecting members, and connector covers. This list is not exhaustive, but is indicative of the variety of devices which perform the terminal locking and/or detecting functions described above. Some types of TPA devices operate in hinged fashion, some in sliding fashion. Some TPA-type devices may even be formed integrally with the connector body, rather than formed separately. Among those TPA-type devices formed separately from the connector body, many are designed to be attached to the connector body in a position adapted to allow the terminals to be inserted while the TPA-type device remains attached to the connector body.

In general, TPA-type devices require relatively complicated molding or manufacturing processes because of the many interacting attachment and terminal-engagement features, and further to accommodate different motions such as the initial attachment of the TPA-type device to the connector body and the subsequent movement of the TPA between pre-engagement and terminal locking positions. For example, hinged terminal-retaining covers or TPA devices require both hinge structure and latch structure to keep the attached covers from interfering with terminal insertion, to place them in a terminal-engaging position after terminal insertion, and to secure them in the terminal-engaging position.

SUMMARY OF THE INVENTION

The present invention is a lengthwise TPA device in combination with an electrical connector especially formed to receive the TPA device in a first pre-engagement condition in which the TPA device is securely attached to the connector at both ends with an intermediate locking projection extending through a slot in the connector. More particularly, in the pre-engagement condition, the TPA is locked at its front end to a front end of the connector, while the rear end of the TPA device is pre-attached to a rearward portion of the connector in a semi-locked state. In this semi-locked state the rear end of the TPA is allowed a limited range of motion away from the terminals, while motion toward its fully locked position is resisted by locking structure on the TPA.

The connector body can be molded by straight action molding with elongated lengthwise slots extending through the connector from its outer, TPA-receiving surface into the terminal cavities. The TPA is provided with intermediate terminal-securing projections or "blocks" which, when the TPA is fully engaged to secure the terminals, extend through the slots in the connector body to abut rear portions of the forward terminal ends or "barrels" inserted in the connector cavities.

The TPA device is formed from a reasonably flexible plastic material, thereby allowing it to flex as it is installed on the connector body in the pre-engagement position, and as it is further snapped into its final, terminal-securing position. The flexible nature of the TPA and the unique blocking and pre-attachment structure at either end of the TPA allows the TPA to be initially assembled, preengaged, and moved to the final terminal-securing position in the manner of a more conventional hinged or rotatable TPA-type device, but with a positive axial lock at both ends to eliminate the possibility of accidental displacement from the terminal-securing position. Further, the semi-locked condition of the TPA terminal insertion end ensures that the terminal insertion end remains open to receive terminals until deliberately locked down.

These and other features and advantages of the invention will become apparent upon further reading of the specification, in light of the accompanying drawings.

BRIEF DESCRIPTION OF THE DRAWINGS

FIG. 8 is a rear perspective view of a fully mated connector and TPA, with one of the terminal chambers in the connector body sectioned to show the TPA device in its terminal-securing position relative to the inserted terminal.

FIG. 9 is a perspective view from the front of the connector with the TPA device assembled thereto.

DETAILED DESCRIPTION OF THE ILLUSTRATED EMBODIMENT

Figure 1:
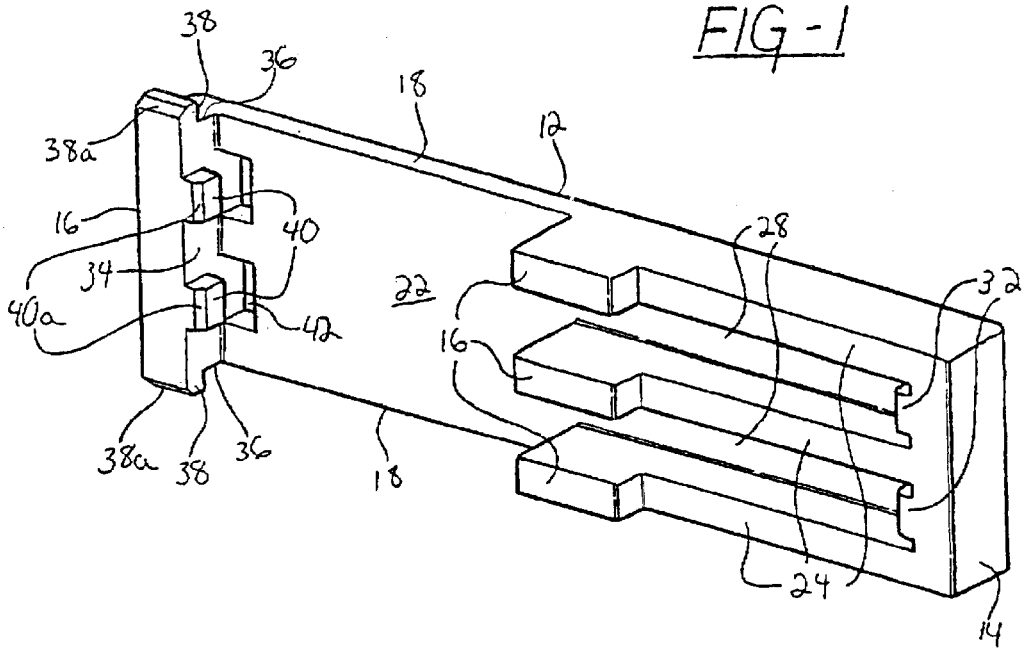
FIG. 1 is a perspective view of the underside of a TPA device according to the present invention.

FIG. 1 illustrates a preferred example of a TPA member 10 according to the present invention, formed from a non-conductive material such as resin, nylon, or some other suitable plastic of the type typically used in the electrical connector art. In the illustrated embodiment TPA member 10 is formed with a suitable molding process.

TPA member 10 has a flat base or cover 12 which in the illustrated embodiment has the overall shape of an elongated rectangle. TPA member 10 has a front end 14 and a rear end 16 and sides 18. Outer surface 20 (FIG. 2) is generally smooth and flat, so that in the illustrated example it functions as a flush extension of a connector body surface when fully installed on a connector, for example as shown in FIG. 9.

TPA member 10 has a flat inner surface 22, a plurality of longitudinal ribs 24 toward front end 14, and a plurality of intermediate shoulders or terminal "blocks" 26 formed at the end of each rib 24 and extending outwardly the greatest distance from flat inner surface 22. Ribs 24 are separated by channels 28. The front ends of channels 28 terminate in latch blocks 32 whose outwardly-facing surfaces are preferably flush with the outwardly-facing surfaces of ribs 24 and end wall 14. Additionally, latch blocks 32 have a depth less than the depth of channels 28, i.e., they extend only partway toward the flat inner surface 22 of TPA member 10 in channels 28.

The rear end 16 of TPA member 10 terminates in an outwardly extending perpendicular end wall 34 whose sides 36 are generally coplanar with sides 18 of TPA cover portion 12 and whose outwardmost end includes ears 38 protruding at right angles to end wall 34 beyond sidewalls 36 and sides 18. In the illustrated embodiment, ears 38 are beveled at 38a for a purpose described below.

End wall 34 is additionally provided with latch blocks 40 similar to latch blocks 32 at the front ends of the TPA member, facing forwardly and extending only partway to the level of flat inner locating surface 22. The illustrated embodiment also shows apertures 42 in cover portion 12, aligned with latch blocks 40. Apertures 42 are simply typical leftovers from the molding operation, and further can be used to assist with an unlatching operation in a manner further described below.

Figure 2:
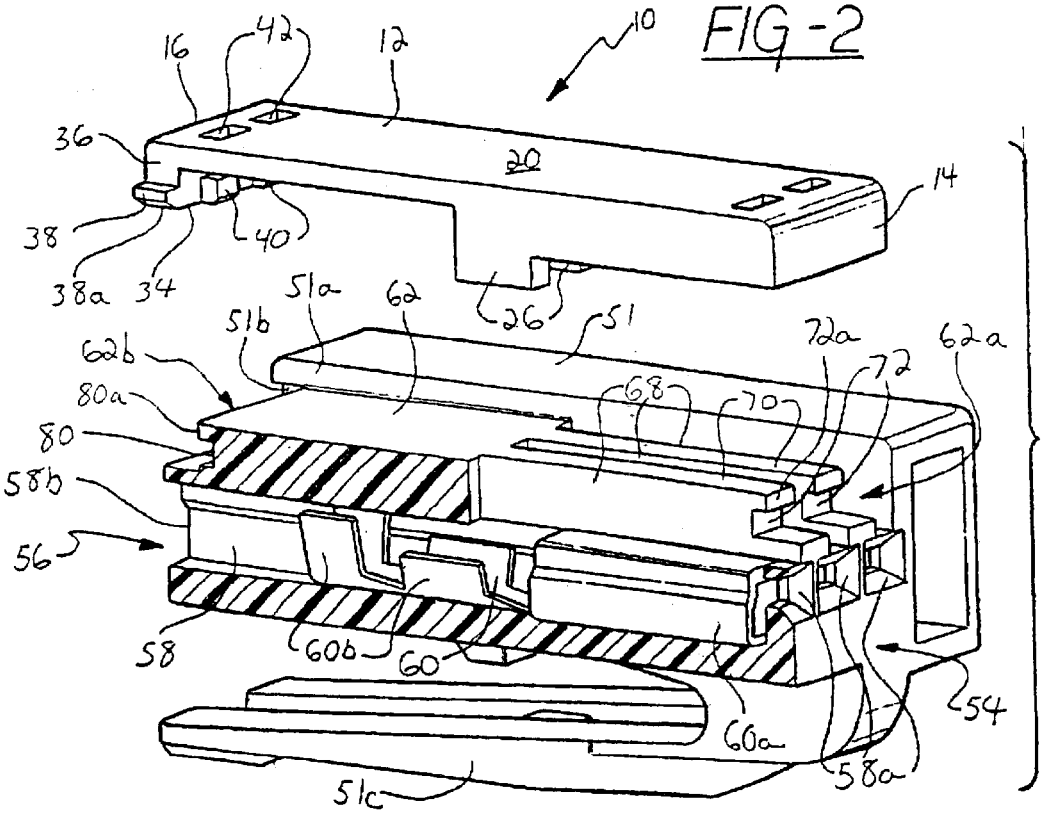
FIG. 2 is an exploded perspective view of the TPA device of FIG. 1 and a specially molded connector with which it is adapted to be mated, with the connector sectioned through a terminal chamber and showing a terminal inserted therein.

Referring next to FIG. 2, TPA member 10 is illustrated in not-yet-assembled association with an electrical terminal connector body 50 of a type generally known for use in automotive vehicles to make wire harness and similar connections, but modified according to the present invention. Like TPA member 10, connector body 50 is typically made from a non-conductive plastic material, although it may for various reasons be made from a material different than the plastic material used for TPA body 10. For example, it is desirable for TPA member 10 to have a degree of flexibility which may not be necessary or even desirable for connector body 50.

The unique attachment and locking structure of the elongated TPA member 10 allows connector body 50 to be molded by "straight action" molding, wherein two mold halves are brought together in a single, straight-line movement to form the molded connector body. This is a significant advantage over many previous TPA and connector body designs, which require multi-step, multi-directional molding processes in order to mold the various attachment and locking structures.

Connector 50 is illustrated as a "female" connector half designed to securely house a plurality of female wire harness terminals 60 in an array of wire harness terminal chambers 58. Female terminals 60 are adapted to receive male wire harness terminals housed in a mating male connector body, which often has a shroud portion adapted to fit over the female connector body while interior male-terminated wires enter the female connector body terminal chambers. It will be understood by those skilled in the art that the overall shape, size, and wire harness terminal chamber configuration of illustrated connector body 50 will vary depending on the particular wire harness application. Moreover, it will be understood that the present invention can be applied to a male connector body as well as a female connector body, provided that the male wire harness terminals are configured to be engaged by TPA member 10 in a manner similar to that about to be described.

Connector body 50 has certain external features which generally are not important to the present invention, including side portions 51 adapted to mate with suitable structure on the male connector body, and a lock arm 51*c* molded integrally with the connector body and adapted to mechanically lock the connector body to suitable mounting structure such as a mating clip or stud on a vehicle panel, electrical component, or wire harness. These and other known features of the connector body will be readily apparent to those skilled in the art, and do not require further description herein.

Between sides 51 lies the portion of connector body 50 adapted according to the invention to receive TPA member 10 for the purpose of securing terminals 60 in their terminal chambers. The foundation of this portion is TPA platform 62 extending lengthwise from a front end 62*a* adjacent the mating end 54 of the connector body to a rear end 62*b* located at or near the rear, terminal-receiving end 56 of the connector body. Platform 62 lies immediately above terminal chambers 58 and the terminals 60 inserted therein, and communicates with a forward portion of each of terminal chambers 58 via a plurality of lengthwise slots 68. Slots 68 extend only through a portion of platform 62, preferably a distance corresponding to forward portions or "barrels" 60*a* of the fully-inserted terminals 60 plus the length of terminal blocks 26 on TPA member 10.

The portions of platform 62 left remaining between slots 68 form ribs 70 which at their forward ends have latch recesses 72 and latch shoulders 72*a* formed therein in a forward-facing manner susceptible of straight action molding.

The rearward end 62*b* of platform 62 includes a widthwise latching recess 80 and latching shoulder 80*a*, rearwardly facing and also susceptible of straight action molding.

It will be seen from the perspective view of FIG. 2 that TPA platform 62 is recessed, with its upper surfaces lying below the upper surfaces of connector body sides 51 so as to define a shoulder or shelf portion 51*a* on each side of platform 62. At the rearward end 62*b* of platform 62, shoulder 51*a* extends over the edge of recessed portion 80 to define an overhanging lip or shelf and a recess 51*b* adapted to matingly receive ears 38 on the rear end of TPA member 10.

In order to achieve a two-stage sequence of pre-attachment and full-locking connection between end 16 of TPA member 10 and end 62*b* of platform 62, it is necessary that either (1) latch blocks 40 are located slightly above ears 38 (i.e., closer to inner flat locating surface 22), or (2) that the bottom edge of shoulder/shelf 51*a* be located slightly above the flat upper surface of platform 62 forming the leading edge of latching shoulder 80*a*. This will become apparent upon further explanation of the mating connection between the rear end 16 of TPA member 10 and connector body 50.

Figure 3:
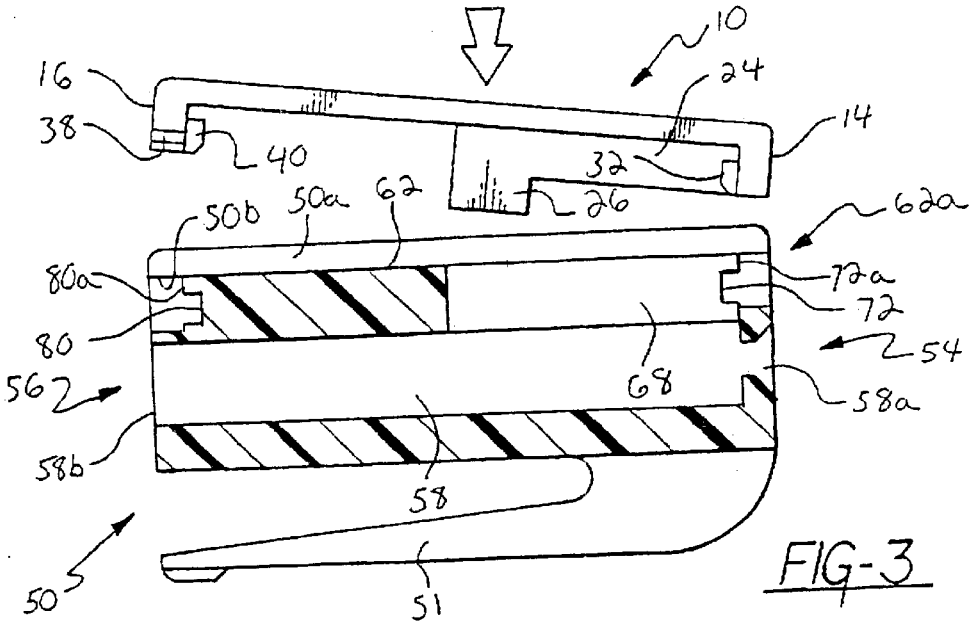
FIGS. 3–7 illustrate the TPA and connector structure of FIG. 2 in side elevational view with the connector sectioned, the TPA and connector being progressively mated.

Referring next to FIG. 3, TPA member 10 is shown being moved perpendicularly down (or up, depending on the orientation of connector body 50) onto connector body platform 62 with the front end 14 of the TPA member canted slightly downward so as to engage the connector body before rear end 16.

Figure 4:
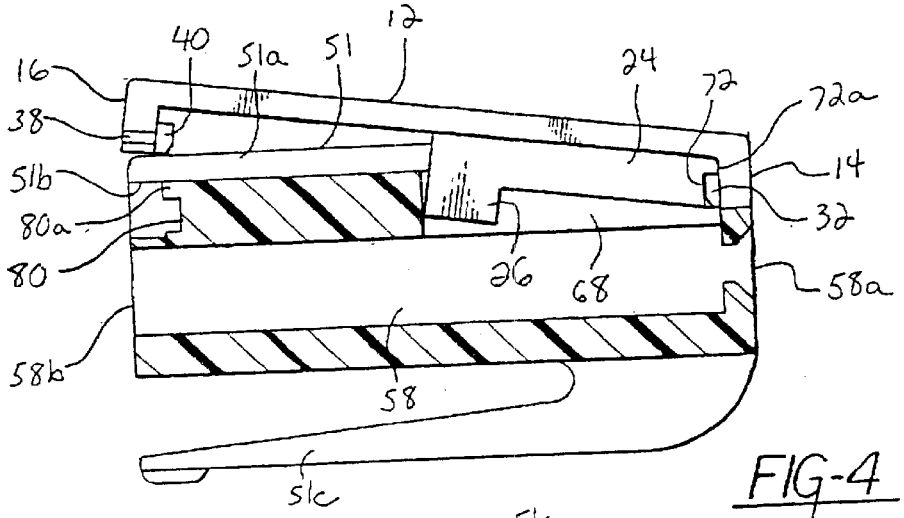

Referring next to FIG. 4, front end 14 of TPA member 10 is first mated with the forward end 62*a* of platform 62. Specifically, as terminal blocks 26 and ribs 24 enter slots 68 on the platform, inwardly-facing latching blocks 32 on the front end 14 of the TPA member snap over latching shoulders 72*a* and fit into latching recesses 72 as shown. Terminal blocks 26 are slightly cocked while rear end 16 of the TPA member 10 and its latching structure 38, 40 remain above platform 62 and shoulders/shelf 51*a* of the connector body sides. At this stage in the assembly process, TPA member 10 is connected to the connector body only at its first end 14.

Figure 5A:
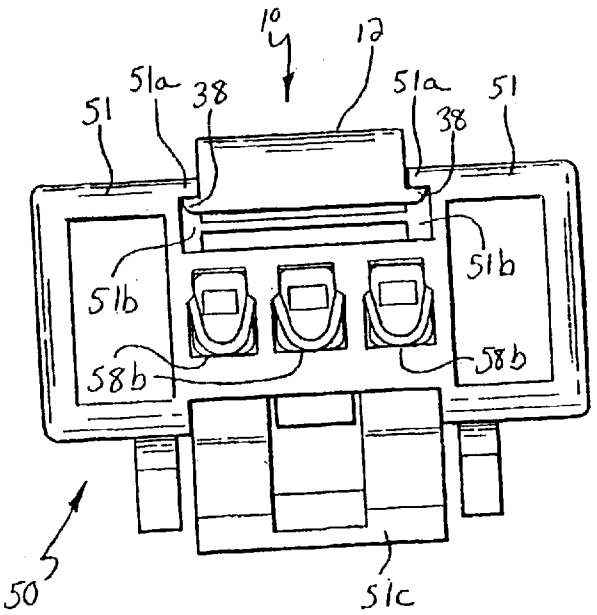
FIG. 5A is a rear (terminal insertion) end view of FIG. 5.
Figure 5:
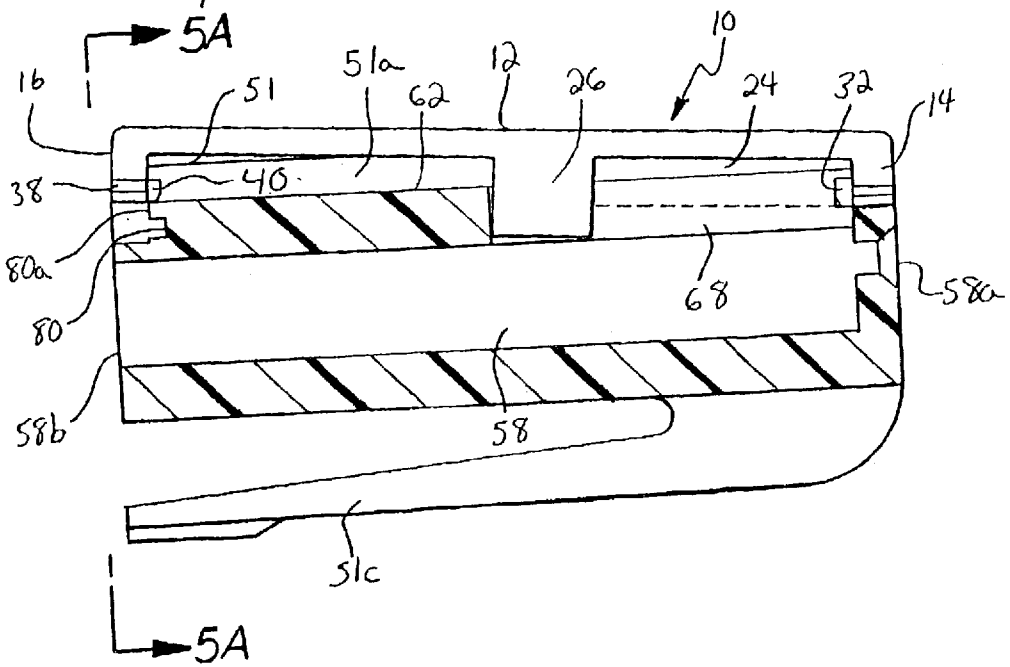

Referring next to FIG. 5, the TPA member 10 is shown in a pre-attached condition in which rear end 16, and in particular ears 38, have been forced downwardly against initial resistance between the outer edges of ears 38 and the rearmost end of shoulder/shelf 51*a* until ears 38 yield and snap underneath shoulder/shelf 51*a* at 51*b*. In this pre-attached condition, latching blocks 40 remain positioned above latching shelf 80*a* on platform 62, such that further downward movement of rear end 16 of the TPA member is resisted by interference between blocks 40 and shelf 80*a*. At the same time, the rear end 16 of TPA member 10 remains securely connected to connector body 50 since the flat upper edges 38*b* of ears 38 are retained underneath shoulders/shelves 51*a* in recesses Sib.

Accordingly, TPA member 10 in the pre-attached condition is axially locked to connector body 50 at both its front and rear ends with movement to the fully locked position being resisted by interference between internal latch blocks 40 and shelf 80*a*. Terminal blocks 26 remain outside terminal chambers 58 to permit terminals 60 to be freely inserted from terminal insertion end 58*b* axially forward to terminal mating end 58*a*. Because rear end 16 of the TPA member is raised above the upper surfaces of sides 51, it provides both a visual and tactile indication that the TPA is pre-attached and will permit the insertion of the wire harness terminals.

Figure 6:
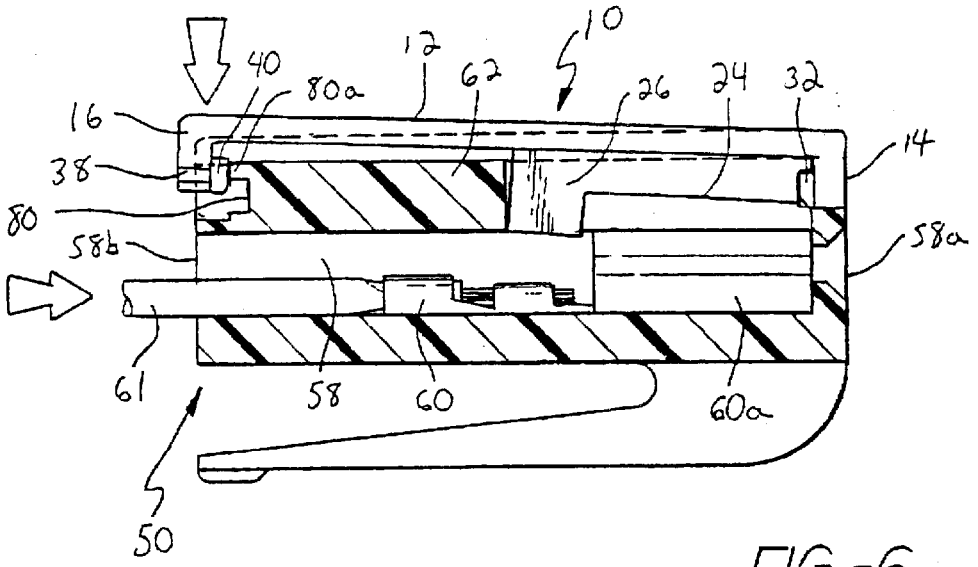

FIG. 6 illustrates two additional steps in the final assembly of TPA member 10 to connector 50. First, terminals 60 secured to the ends of wire harness wires 61 are inserted through the terminal receiving end 58*b* of terminal chambers 58 in connector 50. This occurs with the TPA member 10 in the pre-attached condition shown in FIG. 5. After the forward or "barrel" portions 60*a* of terminals 60 are inserted into their respective chambers 58 all the way forward into abutment with the terminal-mating end 58*a* as shown, the rear end 16 of TPA member 10 is pressed downwardly with the thumb or appropriate tool to override the interference between latching blocks 40 and shelf 80*a* at the rear end of platform 62. In FIG. 6 blocks 40 have been moved partway toward their final position in recesses 80, with the inner faces of blocks 40 sliding over the rear face of shelf 80*a*. It will further be noted that terminal blocks 26 now begin entering terminal chambers 58 to a point behind the rear edges or shoulders of terminal barrels 60*a*. In this state between pre-attachment (FIG. 5) and full locking (FIG. 7), the resistance to further downward movement of TPA end 16 toward the full locking position has largely been eliminated except for face-to-face friction between blocks 40 and shelf 80*a*.

Figure 7A:
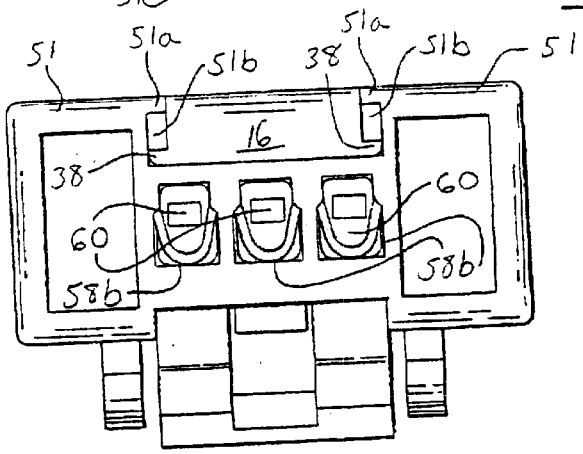
FIG. 7A is a rear (terminal insertion) end view of FIG. 7.
Figure 7:
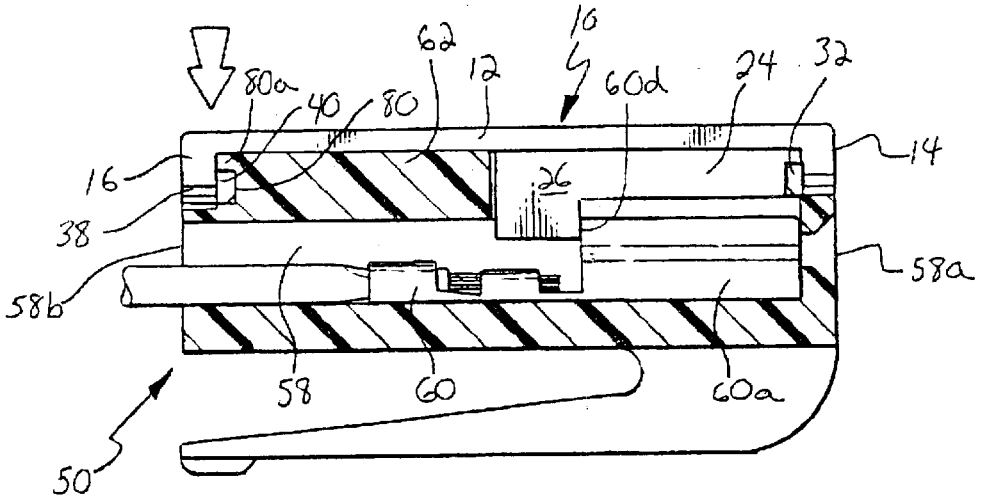

In FIG. 7 the TPA member 10 has been moved to its full-locking position on connector 50. Latching blocks 40 are snapped into place in recesses 80, underneath latching shelf 80*a*, while ears 38 now rest at the bottom of recesses 51*b* as best shown in FIG. 7A. Terminal blocks 26 now extend squarely into terminal chambers 58, seating securely behind and preferably in contact with the rear edge 60*d* of each terminal barrel 60*a*. TPA member 10 is now axially locked at both of its ends to connector body 50, such that nothing short of intentional efforts to disengage it are likely to succeed in removing terminal blocks 26 from behind each terminal barrel 60*a*, thereby locking each terminal 60 securely into connector body 50.

The locking engagement between TPA member 10 (and more specifically terminal blocks 26) and terminal barrels 60*a* is best shown in FIG. 8. FIGS. 8 and 9 also illustrate the preferable flush fit of TPA member 10 with connector body sides 51, giving a visual and tactile indication that the TPA member is in its full-locking condition in which terminals 60 cannot be removed or come loose. Likewise, if the TPA member 10 were to be moved prematurely to the full-locking position prior to an attempt to insert terminals 60, it would be immediately obvious to the assembler that attempts to insert terminals 60 would be fruitless, thereby eliminating the problem of partially-inserted terminals. Moreover, it would not be possible to insert terminals 60 fully into chambers 58, thereby giving an immediate indication on the basis of unnaturally protruding terminal portions that something is wrong.

In the event that it is desirable to remove one or more terminals 60 from their respective chambers 58 in the fully assembled connector structure of FIGS. 8 and 9, it will be apparent to those skilled in the art that apertures 42 above the forward and rearward latching blocks 32, 40 provide space for a tool to be inserted to pry the latching blocks axially out of their respective recesses 72, 80. The preferred flexible nature of TPA member 10 assists with such intentional release operation.

It will be understood that the foregoing illustrated embodiment of a preferred example of the invention is not intended to limit the scope of protection available to the invention and as defined by the claims below. Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true sprit and scope of the invention as claimed in the following claims and as represented by reasonable equivalents to the claimed elements. For example, the exact nature of the TPA attachment and locking structure at the forward and rearward ends of the TPA is not limited to the specific latching block structure shown, but may include other forms of mechanical attachment structure which lends itself to mating with locking structure formed on the ends of the connector platform. Accordingly,

I claim:

1. A terminal position assurance (TPA) member and wire harness connector body combination, the wire harness connector body of the type adapted to receive a plurality of wire harness terminals inserted from a rear terminal-receiving end such that forward portions of the inserted terminals rest in forward terminal-mating ends of the terminal chambers, further comprising;

a TPA platform formed in the connector body above the terminal chambers, the platform having a forward slotted portion with slots extending through the platform and communicating with portions of the terminal chambers behind the forward portions of the inserted terminals, the platform further including forward platform latching structure at a forward end of the platform and rearward platform latching structure at a rearward end of the platform; and the TPA member having TPA latching structure at a forward end thereof and at a rearward end thereof for axially engaging the forward and rearward platform latching structure on the TPA platform, the TPA member further including terminal blocking members located intermediate the forward and rearward TPA latching structure and located to extend through the slots in the slotted portion of the platform when the forward and rearward TPA latching structure is fully engaged with the forward and rearward platform latching structure on the platform, so as to lie behind the forward portions of the inserted terminals and prevent their withdrawal.

2. The TPA member and connector body combination of claim 1, wherein the rearward TPA latching structure includes a pre-attachment portion and a full locking portion, the pre-attachment portion engaging the rearward platform latching structure on the connector body prior to the full locking portion engaging the rearward platform latching structure on the connector body, wherein engagement of the pre-attachment portion with the rearward latching structure places the TPA member in a pre-attached condition in which engagement of the full locking portion with the rearward platform latching structure is resisted.

3. The TPA member and connector body combination of claim 1, wherein the TPA platform is recessed below adjacent surfaces of the connector body, and further wherein at least a portion of the TPA member is raised above the adjacent surfaces of the connector when the forward and rearward TPA latching structure is not fully engaged with the forward and rearward platform latching structure.

4. The TPA member and connector body combination of claim 3, wherein the TPA member is flush with the adjacent surfaces of the connector body when the forward and rearward TPA latching structure is fully engaged with the forward and rearward platform latching structure.

5. The TPA member and connector body combination of claim 1, wherein the TPA member includes apertures adjacent the forward and rearward TPA latching structure providing access to the forward and rearward TPA latching structure when is is fully engaged with the forward and rearward platform latching structure so as to permit the insertion of a tool for disengagement.

* * * * *